United States Patent [19]

Wagner

[11] Patent Number: 4,750,852

[45] Date of Patent: Jun. 14, 1988

[54] BOOK BLOCK TRANSFER LEVEL CORRECTION DEVICE

[75] Inventor: Norbert Wagner, Lohne, Fed. Rep. of Germany

[73] Assignee: Kolbus GmbH & Co. KG, Rahden, Fed. Rep. of Germany

[21] Appl. No.: 38,537

[22] Filed: Apr. 15, 1987

[30] Foreign Application Priority Data

Apr. 26, 1986 [DE] Fed. Rep. of Germany ..... 3614298

[51] Int. Cl.[4] ..... B42B 9/00

[52] U.S. Cl. ..... 412/1; 412/11

[58] Field of Search ..... 412/9–11, 412/1

[56] References Cited

U.S. PATENT DOCUMENTS 4,484,850 11/1984 Shimizu ..... 412/11

FOREIGN PATENT DOCUMENTS 2729222 2/1978 Fed. Rep. of Germany ..... 412/11

*Primary Examiner*—Paul A. Bell

*Attorney, Agent, or Firm*—Chilton, Alix & Van Kirk

[57] ABSTRACT

The invention relates to a device for correcting the levels at which book blocks, emerging from a rounding and backing machine, are transferred to a machine downline, the level corrections being referred to a level predetermined by the latter machine, this level correction device possessing a pair of correcting grippers that grip the book block by means of jaws which can be caused to swing by being driven from a cam mechanism via link motion and lever assemblies that enable the throw of the jaw-swinging movement to be varied by adjusting the slidable link of the link motion within its slot guide. In a device of this type, an arrangement is provided whereby the vertical position of the spine of a book block can be sensed by means of a measuring apparatus (12) which is aligned to a defined level, and the resulting measurement is utilized for controlling a drive (11) that adjusts the slidable link, within its link motion slot guide, in the sense of adjusting the throw of the swinging movement executed by the correcting-gripper jaws (10), use being made of a slidable link (4) that is adjustable within an arc-shaped slot guide (4a).

20 Claims, 2 Drawing Sheets

BOOK BLOCK TRANSFER LEVEL CORRECTION DEVICE

BACKGROUND OF THE INVENTION

The present invention relates to a device for correcting the levels at which book blocks, emerging from a rounding and backing machine, are transferred to a machine downline, the level corrections being referred to a level predetermined by the latter machine.

It is well known that when book blocks undergo the rounding and backing operation, one result is that they emerge with their spines at different levels, and this necessitates a correction for their transfer to a processing machine which is located downline and requires that the spine tops all be at a constant level. This requirement implies that each book block must be raised or lowered by an appropriate, individually determined amount, prior to its acquisition by the transport system of the machine downline.

In known correction devices, use is made of jaws that can be caused to swing, these jaws acting on the side surfaces of the book, in the sense of producing a gripping effect. The throw of this jaw-swinging movement is set by hand, in accordance with a value which is specified in advance, and must therefore be determined. The setting is effected by adjusting a face cam and link motion mechanism that utilizes lever assemblies. The link slot guide associated with known devices is straight, and when it is used, the null, or dead center, point can be determined only by means of a relatively complicated calibration procedure, by reason of the fact that there is no null-point compensation. Determination of the null point is, however, a prerequisite for setting the throw of the jaw-swinging movement.

SUMMARY OF THE INVENTION

It is thus an object of the invention to correct the book block vertical position, to a level predetermined by the processing machines downline, by automatic means which are simply constructed, and which exhibit high functional reliability.

This object is achieved by providing an arrangement whereby the vertical position of the spine of a book block is sensed by means of a measuring apparatus which is aligned to a defined level, and whereby the resulting measurement is utilized for controlling a drive that adjusts the slidable link of a link motion, within its slot guide. This has the effect of adjusting the throw of the swinging movement executed by the jaws of the correcting grippers. Use is made of a slidable link that is adjustable within an arc-shaped slot guide. In an arrangement of this kind, the measuring apparatus can be a light barrier that is capable of controlling the drive in accordance with a defined program.

BRIEF DESCRIPTION OF THE FIGURES

The preferred embodiment of the invention is described in more detail below with reference to the accompanying drawings, in which.

DESCRIPTION OF THE PREFERRED EMBODIMENT

Figure 1:
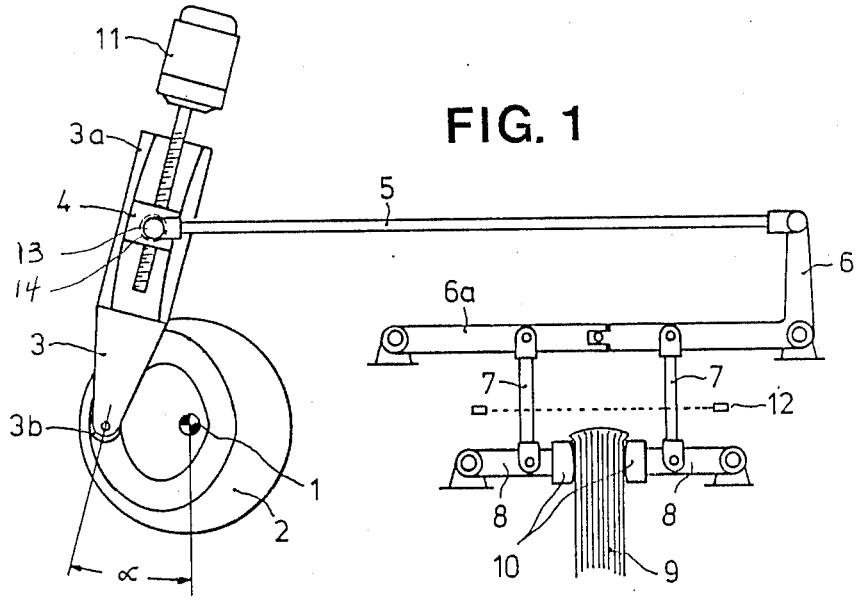
FIG. 1 shows the inventive device in the mid-setting from which the adjustment process starts.
Figure 2:
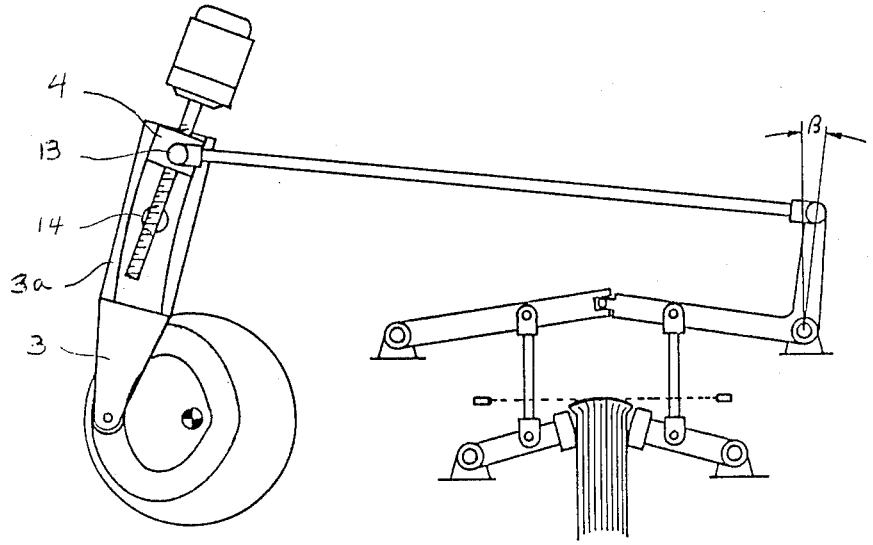
FIG. 2 shows the setting after the adjustment process.
Figure 3:
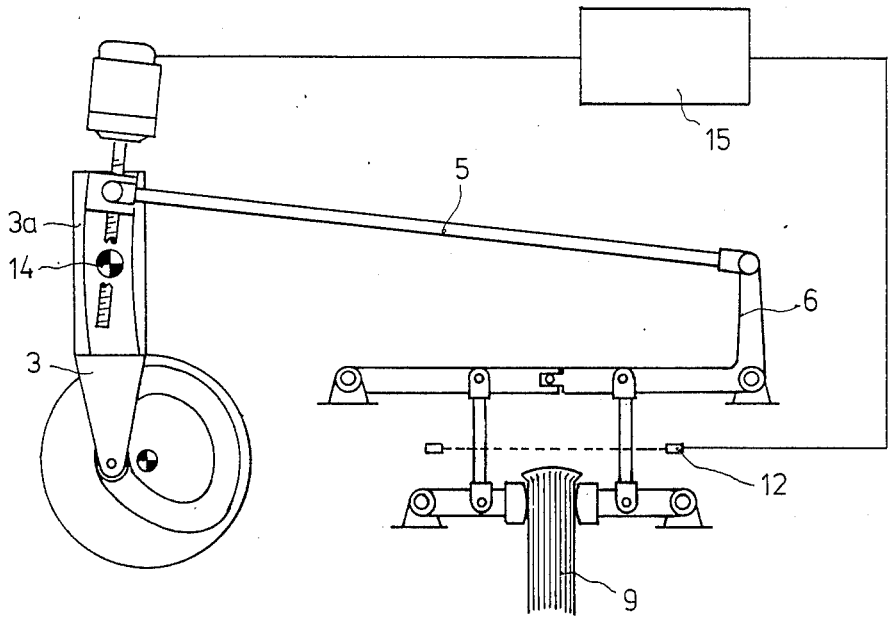
FIG. 3 shows the datum operating setting.

With reference to FIGS. 1–3, there is shown a level correction device possessing a pair of correcting grippers 8 that grip the book block 9 by means of jaws 10 which can be caused to swing by being driven from a cam mechanism 2 via link motion and lever assemblies 3–7. As will be more fully described, this arrangement enables the throw of the jaw-swinging movement to be varied by adjusting a slidable link 4 of the link motion within its slot guide 3*a*.

Shaft 1 and a face cam 2 cause a drive lever 3 to be swung angularly backwards and forwards through a constant angle $\alpha$ in the course of one revolution. The drive lever is pivotally mounted on an axis 14 intermediate its upper and lower ends. A link motion slot guide 3*a*, which is arc-shaped, is located on the lever 3. The slot guide 3*a* contains a slidable link 4 which is connected, via a connecting rod 5, to deflecting levers 6, 6*a*, the connections being made by means of pivot joints. In the illustrated embodiment, the drive lever 3, slot guide 3*a*, and the actuable arm of L-shaped deflecting lever 6 are generally vertically oriented, whereas the connecting rod 5, and the deflecting lever 6*a* and the other arm of deflecting lever 6 are generally horizontally oriented.

Because a book block 9 must be either raised or lowered in order to correct its vertical position, there is a mid-setting (FIG. 1) in which the book block is not moved even when the cam 2 rotates. This setting is characterized by coincidence of the axis 13 of the link pivot joint, at which the link 4 is coupled to one end of the rod 5, with the axis 14 about which the lever 3 swings. As the lever 3 swings, it also swings about the axis of the pivot joint 13, and the book remains in a rest position.

If the slidable link 4 is slid along its arc-shaped slot guide 3*a*, (e.g., to a position as shown in FIG. 2) the axis 13 of the pivot joint moves on concentric circular arcs, centered on the axis 14 about which the lever 3 swings as the lever 3 moves through angle $\alpha$. If the lever 3 is swung through the angle $\alpha$, the deflecting lever 6 swings through the angle $\beta$, depending on the setting of the slidable link 4. FIG. 3 shows the jaw position at the bottom of the throw path, whereas FIG. 2 shows the top of the throw path, corresponding to the angle $\beta$.

The pair of laterally opposed swinging levers 8 are coupled to a respective pair of deflecting levers 6, 6*a* via coupling rods 7. These levers 8 carry a respective pair of correcting-gripper jaws 10 at their opposed ends, for moving through a distance representing their swing throw, thus moving the book.

The adjustment process takes place as follows. First, the drive unit 11 moves the slidable link 4 to the mid-setting of link 4. The book block 9 then enters from the transport carriage of a rounding and backing machine, and arrives between the swinging levers 8 which carry the jaws 10, so as to be acquired by these jaws 10 as a result of their being moved transversely in a conventional manner. The shaft is rotated until the cam roller 3*b* of the lever 3 stands on the largest radius of the curve of the face cam 2 (FIG. 1). The shaft rotation is stopped, the swing angle $\alpha$ having thus been reached.

The null-point shift of the drive can be compensated eliminating the need for any subsequent correction, by reason of the fact that an arc-shaped link motion slot guide 3*a* is utilized. When the lever 3 then moves to its perpendicular position (FIG. 3), the center of the circle corresponding to the arc of guide 3*a* coincides with the point at which the connecting rod 5 is pivotably coupled to the deflecting lever 6. This is the datum operating position, at which subsequent book blocks 9 will be grasped before repositioning to the desired level as the cam 2 rotates to the orientation of FIG. 2.

The vertical position of an incoming book block 9 is sensed by means of a light barrier 12 which is aligned to a defined level, predetermined by the next machine downline, and the result of this sensing process is utilized for controlling the drive unit 11, which shifts the slidable link 4 until the spine of the book block 9 is at the predetermined level (FIG. 2). This control process involves activating the drive unit 11 to move the link 4 above or below the mid setting (FIG. 1) in accordance with a programmed controller 15. Thus, a book block 9 which, on the one hand, arrives below the level of the light barrier is raised until it reaches the barrier, while a book block 9 lying above the light barrier is, on the other hand, lowered until a release signal is obtained.

I claim:

1. A method of operating a device for vertically adjusting book blocks emerging at a first level from a first machine for presentation at a second level that is correct for a second machine, the device including a pair of spaced apart generally horizontal swinging levers having a respective pair of jaws for engaging the book block at said first level and displacing the book block vertically to said second level; a deflection lever assembly including a generally vertical deflection lever having an actuable end, the deflection lever assembly operatively associated with the swinging levers, for swinging the levers upwardly or downwardly together, as a result of the generally horizontal displacement of said actuable end; a generally horizontal connecting rod pivotally connected at one end to said actuable end; a generally vertical drive lever mounted on a first axis intermediate its upper and lower ends; cam means operatively associated with the drive lever lower end for reciprocably displacing the lower end in an arc about the first axis; link means pivotally connected on a second axis to the other end of the connecting rod, said link means being constrained to slide in a generally vertical, arcuate path longitudinally along the drive lever, said arcuate path having a radius of curvature equal to the distance between the pivot connections of the connecting rod to said deflection lever and to said link means; and a drive unit associated with the link means, for longitudinally displacing the link means along the arcuate path, including the steps of:

driving the link means to a mid setting at which said first and second axes are coincident;

feeding a book block at said first level between the jaws and moving the jaws transversely into grasping engagement with the book block;

rotating the cam means until the drive lever is at its maximum angular displacement relative to the vertical;

determining whether the grasped book block is above or below said second level;

driving the link along the arcuate path to a position either above or below the first axis in order to raise or lower the jaws respectively, until the book block spine is at said second level.

2. The method of claim 1, wherein the device further includes sensing means for generating a signal indicative of the level of a book block engaged by said jaws, and programmed control means responsive to said sensing means, wherein the method includes the step of activating the drive unit by the control means to displace the link means in response to said signal.

3. The method of claim 2, including the step of positioning the drive lever exactly vertically so that the center of the circle corresponding to the arcuate path is coincident with the point at which the connecting rod is pivotally coupled to the actuable end of the deflection lever.

4. A device for vertically adjusting the level of a book block, comprising:

a pair of spaced apart swinging levers having a respective pair of jaws for engaging the book block and displacing the book block vertically;

a deflection lever assembly including a deflection lever having an actuable end, the deflection lever assembly operatively associated with the swinging levers, for swinging the upwardly or downwardly together, as a result of the displacement of said actuable end;

a connecting rod pivotally connected at one end to said actuable end;

a drive lever mounted on a first axis intermediate its upper and lower ends;

cam means operatively associated with the drive lever lower end for reciprocably displacing the lower end in an arc about the first axis;

link means pivotally connected on a second axis to the other end of the connecting rod, said link means being constrained to slide in an arcuate path along the drive lever, said arcuate path having a radius of curvature equal to the distance between the pivot connections of the connecting rod to said deflection lever and to said link means; and a drive unit associated with the link means, for displacing the link means along the arcuate path.

5. The device of claim 4, further including sensing means for generating a signal indicative of the level of a book block engaged by said jaws; and programmed control means responsive to said sensing means for activating the drive unit to displace the link means.

6. A device for vertically adjusting book blocks emerging at a first level from a first machine for presentation at a second level that is correct for a second machine, comprising:

a pair of spaced apart generally horizontal swinging levers having a respective pair of jaws for engaging the book block at said first level and displacing the book block vertically to said second level;

a deflection lever assembly including a generally vertical deflection lever having an actuable end, the deflection lever assembly operatively associated with the swinging levers, for swinging the levers upwardly or downwardly together, as a result of the generally horizontal displacement of said actuable end;

a generally horizontal connecting rod pivotally connected at one end to said actuable end;

a generally vertical drive lever mounted on a first axis intermediate its upper and lower ends;

cam means operatively associated with the drive lever lower end for reciprocably displacing the lower end in an arc about the first axis;

link means pivotally connected on a second axis to the other end of the connecting rod, said link means being constrained to slide in a generally vertical, arcuate path longitudinally along the drive lever, said arcuate path having a radius of curvature equal to the distance between the pivot connections of the connecting rod to said deflection lever and to said link means; and a drive unit associated with the link means, for longitudinally displacing the link means along the arcuate path.

7. The device of claim 6, further including sensing means for generating a signal indicative of the level of a book block engaged by said jaws; and programmed control means responsive to said sensing means for activating the drive unit to displace the link means.

8. The device of claim 7 wherein said first axis intercepts said arcuate path such that said link means can be driven to a position in the arcuate path whereby said second axis is coincident with the first axis.

9. The device of claim 8 wherein when the drive lever is oriented exactly vertically, the center of the circle corresponding to the arcuate path is coincident with the point at which the connecting rod is pivotally coupled to the actuable end of the deflection lever.

10. The device of claim 9 wherein:

said cam means includes a shaft oriented transversely to the connecting rod and a face cam having a contour with a maximum radius of curvature and a minimum radius of curvature;

said drive lever includes a cam roller at its lower end, engaging said face cam contour; and the contour is sized such that the drive lever is oriented exactly vertically when the cam roller is on said minimum radius of curvature.

11. The device of claim 7 wherein said sensing means is a light beam at said second level, interruptable by the vertical displacement of a book block in the grasp of said jaws.

12. The device of claim 6 wherein said first axis intercepts said arcuate path such that said link means can be driven to a position in the arcuate path whereby said second axis is coincident with the first axis.

13. The device of claim 12 wherein when the drive lever is oriented exactly vertically, the center of the circle corresponding to the arcuate path is coincident with the point at which the connecting rod is pivotally coupled to the actuable end of the deflection lever.

14. The device of claim 13 wherein:

said cam means includes a shaft oriented transversely to the connecting rod and a face cam having a contour with a maximum radius of curvature and a minimum radius of curvature;

said drive lever includes a cam roller at its lower end, engaging said face cam contour; and the contour is sized such that the drive lever is oriented exactly vertically when the cam roller is on said minimum radius of curvature.

15. The device of claim 13 further including sensing means for generating a signal indicative of the level of a book block engaged by said jaw; and programmed control means responsive to said sensing means for activating the drive unit to displace the link means.

16. The device of claim 15 wherein:

said cam means includes a shaft oriented transversely to the connecting rod and a face cam having a contour with a maximum radius of curvature and a minimum radius of curvature;

said drive lever includes a cam roller at its lower end, engaging said face cam contour; and the contour is sized such that the drive lever is oriented exactly vertically when the cam roller is on said minimum radius of curvature.

17. The device of claim 13 wherein the guide path is a slot guide cut out in said drive lever.

18. The device of claim 17 wherein the deflection lever assembly includes:

a vertical coupling rod pivotally connected at one end to each swing lever;

a straight, horizontal deflection lever pivotally connected to the other end of one coupling rod; and a generally L-shaped deflection lever having a horizontal arm pivotally coupled to the other coupling rod and to the horizontal deflection lever, and having a vertical arm constituting said vertical deflection lever.

19. The device of claim 6 wherein:

said cam means includes a shaft oriented transversely to the connecting rod and a face cam having a contour with a maximum radius of curvature and a minimum radius of curvature;

said drive lever includes a cam roller at its lower end, engaging said face cam contour; and the contour is sized such that the drive lever is oriented exactly vertically when the cam roller is on said minimum radius of curvature.

20. The device of claim 19 wherein when the drive lever is oriented exactly vertically, the center of the circle corresponding to the arcuate path is coincident with the point at which the connecting rod is pivotally coupled to the actuable end of the deflection lever.

* * * * *

UNITED STATES PATENT AND TRADEMARK OFFICE

CERTIFICATE OF CORRECTION

PATENT NO. : 4,750,852

DATED : June 14, 1988

INVENTOR(S) : Norbert Wagner

It is certified that error appears in the above-identified patent and that said Letters Patent is hereby corrected as shown below:

Claim 4, column 4, line 18, insert the word "levers" before "upwardly".

Signed and Sealed this

Twenty-seventh Day of December, 1988

*Attest:*

DONALD J. QUIGG

*Attesting Officer*

*Commissioner of Patents and Trademarks*